United States Patent [19]

Weiler et al.

[11] Patent Number: 4,526,279

[45] Date of Patent: Jul. 2, 1985

[54] SEVERING OVERCAP FOR CONTAINER

[75] Inventors: Gerhard H. Weiler, South Barrington; Louis T. Pagels, Hanover Park, both of Ill.

[73] Assignee: Automatic Liquid Packaging, Inc., Arlington Heights, Ill.

[21] Appl. No.: 539,576

[22] Filed: Oct. 6, 1983

[51] Int. Cl.[3] ..... B65D 1/02

[52] U.S. Cl. ..... 215/32

[58] Field of Search ..... 215/32, 33, 250, 251, 215/252

[56] References Cited

U.S. PATENT DOCUMENTS

| | | | |
|---|---|---|---|
| 4,176,755 | 12/1979 | Winchell | 215/32 |
| 4,207,990 | 6/1980 | Weiler et al. | 220/267 |
| 4,378,891 | 4/1983 | Fowles et al. | 215/32 |
| 4,402,415 | 9/1983 | Hopley | 215/32 |

*Primary Examiner*—Donald F. Norton

*Attorney, Agent, or Firm*—Dressler, Goldsmith, Shore, Sutker & Milnamow, Ltd.

[57] ABSTRACT

An overcap is provided for use with a hermetically sealed container which includes at least an external thread on a peripheral portion of the container, a cover portion closing the container, and a frangible web joining the cover portion to the container threaded portion. The overcap has a closed end, an open end, and at least a generally cylindrical inner peripheral portion oriented about a longitudinal axis with an internal thread on the interior of the overcap. A plurality of flexible fingers is provided on the interior of the overcap and project from the overcap between the overcap thread and the overcap closed end. Each finger projects inwardly toward the longitudinal axis and toward the closed end to accommodate the screwing of the overcap onto the container so that the overcap is operable upon rotation in the unscrewing direction to exert an axial force against the cover portion to fracture the frangible web for removal of the cover portion.

16 Claims, 3 Drawing Figures

SEVERING OVERCAP FOR CONTAINER

Technical Field

This invention relates to containers, such as thermoplastic containers, which are hermetically sealed and which can be opened by fracturing, severing, breaking, or rupturing a frangible web.

BACKGROUND OF THE INVENTION

Hermetically sealed containers with unitary closures are known in the art. Generally, such containers are made using apparatus and methods for forming, filling, and sealing as disclosed generally in the U.S. Pat. No. Re. 27,155 and in the U.S. Pat. No. 3,597,793. Typically, such containers are of unitary construction and may be provided with a closure that can be severed to permit removal of the closure and to permit access to the contents in the container. Containers of this general type are well suited for sterile and aseptic packaging of various liquids.

A number of designs for such unitary containers have been proposed wherein the closure can be severed from the container by rotating a ring in threaded engagement with the container. Such containers typically include a neck portion with an external thread, a cover portion closing the neck portion, and a frangible web joining the cover portion to the neck portion. A ring is provided with an internal thread for engaging the external thread on the container neck portion. As the ring is rotated in one direction on the neck portion, part of the ring engages the cover portion and forces it in an axial direction relative to the container neck portion so as to sever the frangible web.

Of interest in this regard are the designs disclosed in the U.S. Pat. Nos. 4,176,755 and 4,207,990. U.S. Pat. No. 4,176,755 discloses a container with an outer ring having external protuberances which engage an outwardly extending bearing surface of the container closure or cover portion. When the ring is screwed downwardly with respect to the container neck portion, a portion of the ring forces the container cover portion downwardly to fracture the frangible web and separate the cover portion from the container neck portion. Next, to permit access to the container contents and to permit the contents to be discharged from the container, the ring is screwed upwardly relative to the container neck portion. This causes the top of each protuberance to engage a retaining abutment on the now severed cover portion so as to lift the separated cover portion as the outer ring is unscrewed from the container.

U.S. Pat. No. 4,207,990 discloses a container with a collar or ring having a plurality of blades engaged with the underside of an annular flange projecting outwardly above the severable web joining the container cover portion to the container neck portion. When opening the container, the ring is rotated in the direction to unscrew it from the container neck portion. This forces the blades to abut the underside of the flange. Upon further elevation of the ring as it is rotated, the blades are deflected inwardly so as to incise the frangible web while at the same time exerting an upward lifting force on the flange. Continued elevation of the ring results in complete removal of the cover portion from the neck portion of the container, thereby exposing an access opening to the container.

Although the above-discussed containers may be satisfactorily opened by proper operation of the opening rings, it would be desirable to provide an improved design having advantages not found in such current designs. Specifically, in those situations where sterility, dust, or dirt accummulation may be a problem, it would be desirable to provide means for eliminating, or at least minimizing, the possibility that contaminants may be deposited at or near the container cover portion.

By the same token, it would be desirable to eliminate or reduce access to the frangible web area of the container so as to eliminate, or substantially reduce, the likelihood of contamination of the frangible web area. In this respect, it is to be noted that in each of the above-discussed current designs, the opening ring elements instrumental in severing the cover portion are exposed to the ambient atmosphere and to the contaminants therein. Further, the frangible web region is also exposed to the ambient atmosphere in the design disclosed in U.S. Pat. No. 4,207,990.

The frangible web region in the design shown in U.S. Pat. No. 4,176,755 can also be exposed to the ambient atmosphere if the opening ring is threaded upwardly a slight amount providing space between the container cover portion and the opening ring at the base of the protuberances even though it may not be apparent to the casual observer that such a contaminant flow path exists. Indeed, if this situation were not noted and corrected, the region between the opening ring and the frangible web could retain contaminant material. Then, when the container cover portion is opened by rotating the ring further to actually fracture the frangible web, the accumulated contaminants could enter the contents of the container as the cover portion is removed from the container. Accordingly, it would be desirable to provide a design in which the container frangible web region is protected and not susceptible to such potential contamination.

Finally, it would be beneficial to provide an efficient means for effecting the severing of the cover portion from the container neck portion in a manner that would not require an undue amount of applied torque. In this respect, it is to be noted that each of the extraneous members of the opening ring in each of the above-discussed current designs are arcuate for engaging the circumferential surface of the container cover portion. Thus, when the opening ring is rotated to effect the severing of the frangible web, the leading edge of each member may dig into the adjacent wall of the cover portion. This, at a minimum, will create a greater frictional force and, in any event, will require increased torque to continue the rotation of the opening ring so as to provide sufficient axial thrust to fracture the frangible web. Accordingly, it would be desirable to provide an improved structure for opening such a container with a reduced torque requirement.

SUMMARY OF THE INVENTION

The overcap of the present invention is well suited for use with a hermetically sealed container. However, in its broadest aspects, the overcap can be used with any container that includes at least an external thread on a portion of the container, a cover portion closing the container, and a severable juncture joining the cover portion to the container threaded portion. The overcap has a closed end and an open end for receiving the container cover portion and the threaded portion. The overcap also has a hollow portion with an internal thread and oriented about a longitudinal axis that passes through the closed end.

A plurality of flexible fingers integral with the overcap are provided about the periphery of the interior of the overcap. The fingers are positioned between the threaded overcap portion and the closed end. Each finger projects inwardly toward the longitudinal axis and also toward the closed end to accommodate the screwing of the overcap onto the container so that the overcap fully envelopes the container cover portion and is operable upon rotation in the unscrewing direction to exert through the fingers an axial force against the cover portion. This manipulation fractures the frangible web at the line of weakness for removal of the cover portion.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

DESCRIPTION OF PREFERRED EMBODIMENT

Figure 1:
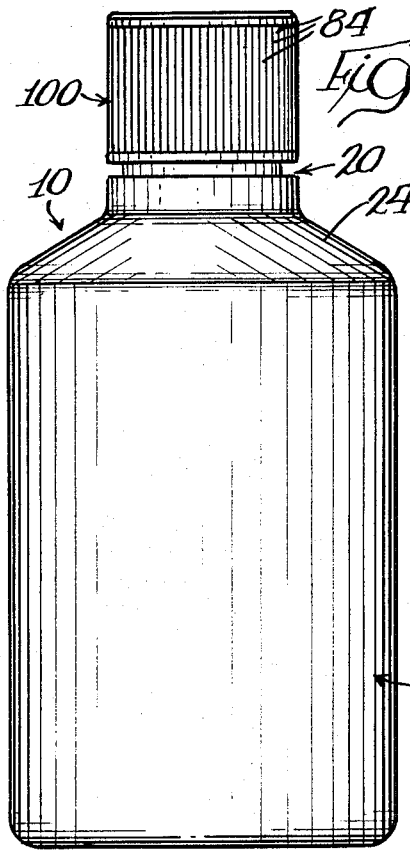
FIG. 1 is a front elevational view of a container with an overcap embodying the present invention.

The invention disclosed herein is, of course, susceptible of embodiment in many different forms. Shown in the drawing and described hereinbelow in detail is a preferred embodiment of the invention. It is to be understood, however, that the present disclosure is an exemplification of the principles of the invention and does not limit the invention to the illustrated embodiment.

For ease of description, a package constituted by a container equipped with the overcap embodying the present invention is described hereinbelow in its usual assembled position as shown in the accompanying drawing, and terms such as upper, lower, horizontal, etc., will be used herein with reference to this usual position. However, the container and overcap may be manufactured, stored, transported, sold, or used in orientations other than that described and shown herein.

The apparatus as well as the manufacturing expedients taught in the aforemetioned U.S. Pat. No. Re. 27,155 and No. 3,597,793 can be readily utilized to manufacture the container for use with the overcap embodying the present invention. However, while economic advantages are readily realized by the automatic forming, filling, and hermetic sealing as taught in the foregoing patents, the container can also be formed first and then filled and sealed in separate operations, if desired.

The container is preferably fabricated from conventional thermoplastic molding materials such as polyethylene (low and high density), polypropylene, polycarbonate, polyester, and like materials compatible with the container contents. The overcap may be fabricated from the same or different materials, as desired, usually by injection molding techniques.

Referring now to the drawing, the container is designated generally by the reference numeral 10 and the overcap for use therewith by the reference numeral 100. Overcap 100 of the present invention is designed for use with a container that is hermetically sealed and that includes at least the following features: an external thread 12 (FIG. 3) on a portion of the container, a cover portion 14 (FIGS. 2 and 3) closing the container 10, and a severable web 16 (FIG. 3) joining the cover portion 14 to the threaded portion of the container.

In the preferred embodiment illustrated, the web 16 is frangible and is formed with a reduced thickness of material. Web 16 defines a line of weakness between the portion of the container having the thread 12 and the container cover portion 14. The portion of the container with the external thread 12 forms part of a neck portion 20 of the container 10. The thread 12 is a continuous, helical thread. The neck portion 20 extends from the frangible web 16 to a hollow body portion 22 (FIG. 1) of the container 10. The hollow body portion 22 is typically the largest diameter portion of the container 10, and the neck portion 20 typically includes a transition section 24 which merges with, and joins, the top of the hollow body portion 22. The transition section 24 provides a reduction in diameter so that the neck portion 20 forms a conveniently sized discharge opening and has a thread diameter that accommodates a convenient size overcap 100.

The overcap 100 is an elongate hollow body and has a closed end that is preferably defined by an end wall 70. The overcap 100 also has an open end 72 (FIG. 3) opposite the end wall 70 for accommodating placement of the overcap 100 on the container 10. The hollow body or peripheral portion in the illustrated preferred embodiment is defined by a generally cylindrical peripheral wall 76 (FIG. 3).

At least the wall 76 is oriented about a longitudinal axis 77 and has an internal thread 80 (FIG. 3) on the interior of the overcap 100. In the illustrated embodiment the thread 80 is a continuous, helical thread.

Although at least a portion of the wall 76 defines a generally cylindrical, hollow, peripheral portion provided with internal thread 80, it is to be realized that the exterior surface of the wall 76 need not necessarily be cylindrical and may have some other configuration. In the embodiment illustrated, the exterior surface of the wall 76 is generally cylindrical, but it also has a plurality of vertically aligned grooves 84 to facilitate gripping of the overcap. Other gripping means are suitable as well.

Figure 3:
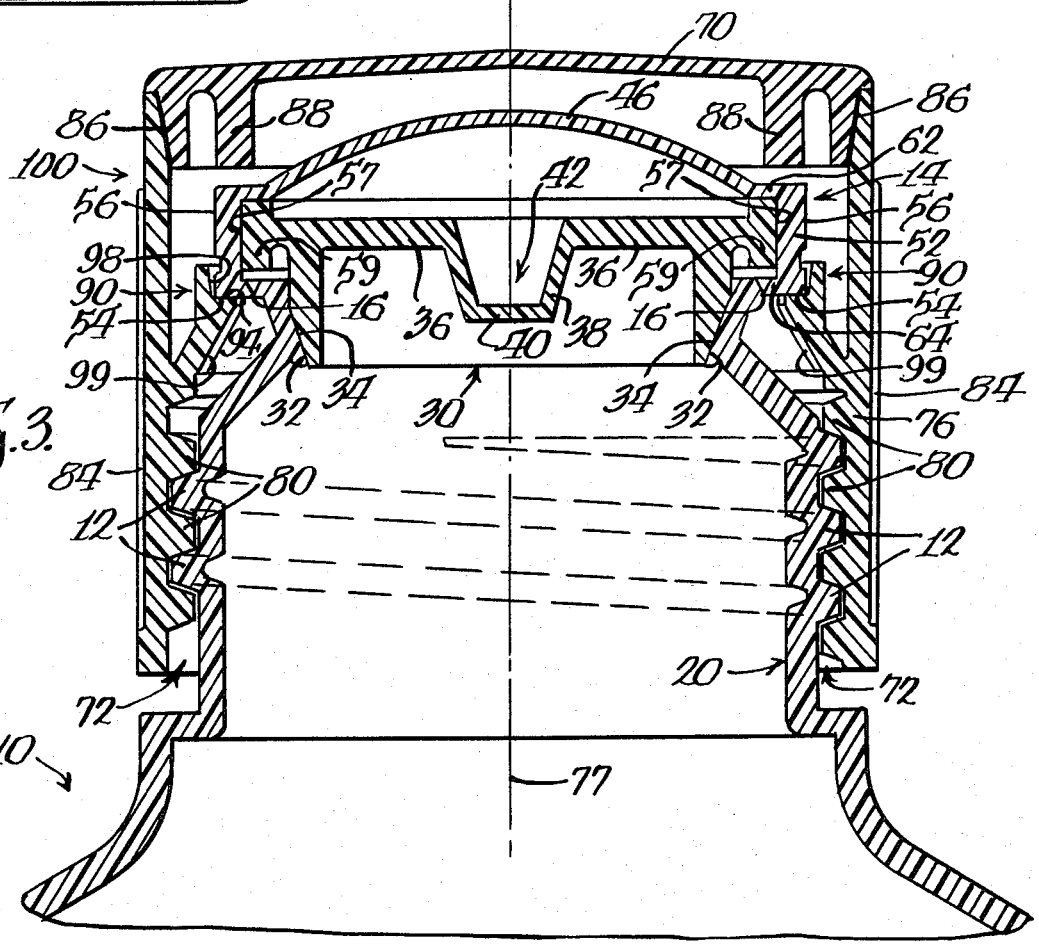
FIG. 3 is a fragmentary, cross-sectional view taken generally along the plane 3—3 in FIG. 2.

In the illustrated embodiment, the end wall 70 of the overcap 100 is initially fabricated as a separate member and is then joined, preferably by spin welding, to the peripheral wall 76 as indicated by the heavy dark line designated by reference numeral 86 (FIG. 3). Further, the end wall 70 is preferably provided with an annular bearing member 88 for engaging the cover portion 14 (after the cover portion 14 has been severed from the container) in a manner described hereinafter in detail.

The overcap 100 also has a plurality of flexible fingers 90 contained within. As best illustrated on the left-hand side of FIG. 3, each finger 90 is located on the interior of the overcap 100 and extends from the overcap 100 between the overcap thread 80 and the end wall 70 at the overcap closed end. Each finger 90 projects inwardly toward the longitudinal axis 77 of the overcap 100 and toward the closed end of the overcap 100.

Each finger 90 has an upwardly facing bearing surface 94 adapted to engage or bear against an abutment suface of the container cover, e.g., the downwardly facing bottom surface 54 of the cover portion base portion 52. Each finger 90 also has an inwardly facing abutment surface 98 which is adapted to engage the circumferential peripheral surface 56 of the cover portion base portion 52. The bearing surface 94 and the abutment surface 98 cooperate to define a generally right angle when viewed in cross-section as in FIG. 3.

Figure 2:
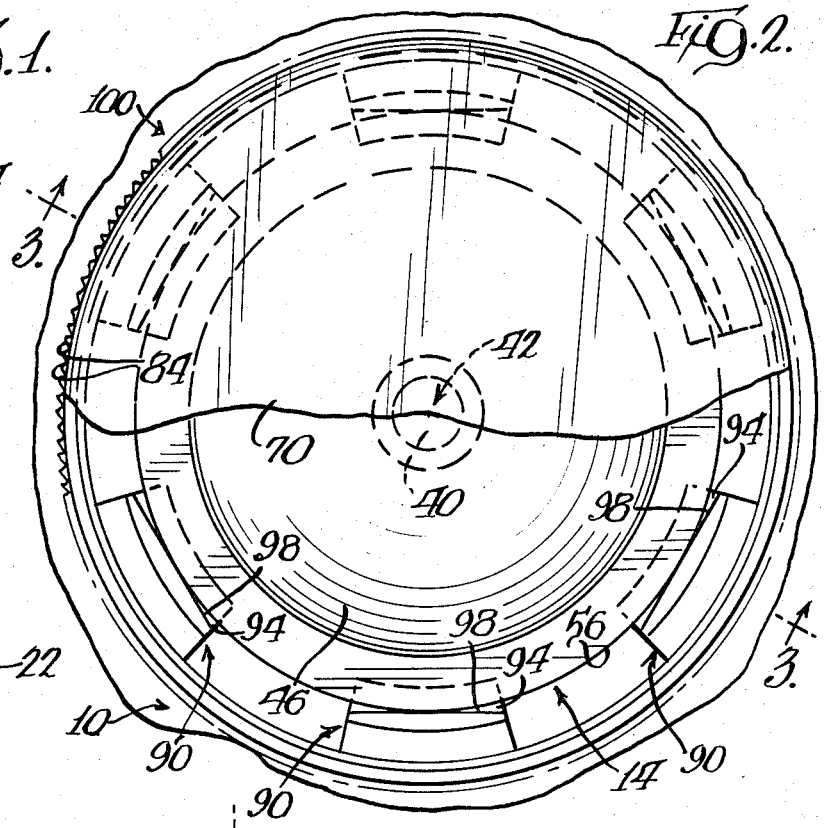
FIG. 2 is a greatly enlarged, fragmentary, top view of the container and overcap of FIG. 1 with a portion of the overcap cut away to illustrate interior detail.

The bearing surface 94 is generally flat as best illustrated in FIG. 3 and extends around a portion of the overcap interior as best illustrated in FIG. 2. The abutment surface 98 is generally planar so as to make substantially point contact, and thus minimal contact, with the cover portion peripheral surface 56 adjacent the bearing surface 94 as best illustrated in FIG. 2. Alternately, abutment surface 98 can be convex for the same reason.

In the embodiment illustrated, there are six fingers 90 equally spaced about the interior of the overcap 100. Each of the fingers 90 projects inwardly toward the longitudinal axis 77 of the overcap 100 beyond the innermost projection of the overcap thread 80. However, each finger 90 is also slightly flexible, at least in the direction radially outwardly from the longitudinal axis 77, and has a slanted undersurface 99 so as to accommodate mounting of the overcap 100 to the container 10.

Preferably, a separate inner closure 30 is captured within, and partially encapsulated by, the cover portion 14 to provide a seal between frangible web 16 and the container contents. The inner closure 30 preferably has a tapered or frustoconical side wall 32 which sealingly engages a mating tapered or frustoconical wall or seat 34 of the container neck portion 20 below the frangible web 16. The separate closure 30 has a cross wall 36 with a downwardly depending frustoconical wall 38 and a circular bottom wall 40 which together define a frustoconical debossment or reservoir 42 for receiving and containing a small aliquot of liquid (not illustrated) that can be vaporized during container sterilization to prevent collapse of dome portion 46 in cover portion 14. The reservoir 42 opens upwardly toward dome portion 46. The space below the dome portion 46 is thus in communication with reservoir 42 and with any liquid which may be deposited therein as a step during the fabrication of the sealed container 10 as will next be explained.

After container 10 is formed and filled, inner closure 30 is positioned as shown in FIG. 3 by means of a secondary operation, and a drop of water or other suitable vaporizable liquid is placed within the reservoir 42. The container sealing operation is then effected to form the closure portion 14 with the dome portion 46 formed over and enclosing the separate inner closure 30. The amount of vaporizable liquid needed for a particular closure structure can vary according to the liquid used and according to the size and configuration of the container. It is not practical to give exact values for this minimum amount of liquid for all types of liquids which can be employed and for all possible embodiments of the present invention, but the minimum amount of liquid can be readily and simply ascertained by workers in the art for a given liquid and for a given container material and configuration.

In any event, regardless of whether or not a separate inner closure 30 is included in the container 10 and regardless of whether or not the reservoir 42 is included in such a closure 30, the cover portion 14 preferably includes an annular base portion 52 (FIG. 3) that projects radially outwardly from its point of connection with the neck portion 20 (at the frangible web 16). The base portion 52 presents a downwardly facing bottom surface 54 for engagement by flexible fingers 90 of the overcap 100 and a circumferential peripheral surface 56.

If an inner closure 30 is provided, then the base portion 52 encircles and sealingly engages a peripheral surface 57 of a flange 59 on the inner closure 30. The base portion 52 has an upper, inwardly extending annular flange 62 sealing against the top of the inner closure flange 59 and also has a lower, inwardly extending annular flange 64 which terminates in the frangible web 16. The separate inner closure 30 is thus seen to be captured between the two flanges 62 and 64.

The container 10 is initially formed, filled and sealed before the overcap 100 is applied. If desired, the container 10 is sealed by conventional techniques with the cover portion 14 over the separate inner closure 30 as illustrated in the preferred embodiment. However, such a separate inner closure 30 may be omitted if a resealable container is not desired. In any case, after the sealed container 10 has been fabricated, and after the sealed container 10 has sufficiently cooled, the overcap 100 is then positioned on the container neck portion 20 by threading on external thread 12.

As the slanted undersurface 99 of each finger 90 engages the top corner of the cover portion base portion 52, each finger 90 is temporarily deflected outwardly as it is carried past the upper part of the cover portion 14 by the camming action of undersurface 99. After the overcap 100 has been threaded onto the container neck portion 20 a sufficient amount, each finger 90 springs inwardly to assume its undeflected, rest position where the bearing surface 94 can engage the cover portion 14. The overcap 100 may be screwed downwardly further than illustrated in FIG. 3 so that there is a slight gap between the downwardly facing bottom surface 54 of the cover portion 14 and the upwardly facing bearing surface 94 of each finger 90. The lowermost position of the overcap 100 on the container neck portion 20 is determined by the point at which the overcap end wall bearing member 88 abuts the upper flange 62 of the cover portion 14.

When it is desired to open the container 10, the overcap 100 is unscrewed from the container neck portion 20. The upwardly facing bearing surface 94 of each finger 90 is thus caused to bear against the downwardly facing bottom surface 54. Further upward movement of the overcap 100 exerts an axial force against the cover portion 14 to fracture the line of weakness at the frangible web 16 for removal of the cover portion 14.

As each finger 90 is forced into engagement with the cover portion bottom surface 54, the tendency of each angled finger 90 to be deflected inwardly is resisted by the abutment surface 98 on each finger 90. The abutment surface 98 of each finger 90 engages the peripheral surface 56 of the cover portion 14. Since the engagement is minimal, there is a minimum of frictional contact between the abutment surface 98 and the cover portion 14. Further, since the abutment surface 98 preferably is planar or convex and thus does not follow the curvature of the cover portion 14, there is no danger that the leading corner or edge of the abutment surface 98 will dig into the cover portion 14. This minimizes the amount of torque required to unscrew the overcap 100.

When the overcap 100 is completely unscrewed and removed from the container neck portion 20, the severed part of the cover portion 14 is trapped within the overcap 100 between the overcap fingers 90 on the bottom and the overcap bearing member 88 on the top. The severed part of the closure portion 14 may have some degree of axial movement within the overcap 100 as determined by the amount of clearance initially provided in the structure (each clearance being visible in FIG. 3 as the space between the bottom of the overcap end wall bearing member 88 and the top of the upper flange 62 of the cover portion base portion 52).

If a separate inner closure 30 has been provided in the container 10 as illustrated, that inner closure 30 is similarly trapped or captured between the upper flange 62 of the cover portion 14 and the lower flange 64 of the cover portion 14. The separate inner closure 30 also will have some amount of axial movement within the severed part of the cover portion 14 as determined by the initial clearance space initially provided in the cover portion 14. Such initial clearance space is illustrated in FIG. 3 immediately above the cover portion lower flange 64 and below the bottom of the inner closure flange 59.

When it is desired to reclose and reseal the container 10, the overcap 100, with the severed part of the cover portion 14 and inner closure 30 retained within, is threadingly re-engaged with the container neck portion 20. As the overcap 100 is screwed down onto the neck portion 20, the separate inner closure 30 becomes centered and seals against the frustoconical seat 34 of the container neck 20.

Tight sealing is assured by screwing the overcap 100 down so that the overcap end wall bearing member 88 engages the upper flange 62 of the cover portion 14. Since the frangible web 16 has been severed, the overcap 100 can be screwed down even further until the severed part of the cover portion 14 is forced sufficiently below the position illustrated in FIG. 3 as may be necessary to insure a tight seal of the separate inner closure 30 with the container neck portion 20. In the resealed orientation, the overcap fingers 90 will be spaced somewhat below the severed part of the cover portion 14 and the overcap end wall bearing member 88 will be in tight engagement with the upper flange 62 of the severed part of the cover portion 14.

When the novel overcap design of the present invention is employed in cooperation with the container 10, it is seen that the fingers 90 are entirely contained within a shielded, closed structure. Neither the fingers 90 nor the cover portion 14 are exposed to external contaminants.

Further, the novel overcap configuration closes off the container neck portion and prevents or substantially reduces the ingress of contaminants to the region of the frangible web. Dust, dirt or microorganism penetration is precluded by the engaged threads. Thus, when the container is opened, contaminants will not be present in the frangible web region, and there is no danger that contaminants will be carried into the container contents during the opening process or as the container is emptied.

Further, owing to the novel design configuration of the fingers 90, the overcap can be unscrewed with a reduced amount of required torque. This advantage is realized because the abutment surfaces of the fingers effect only a minimal contact, preferably a line contact, and present no sharp edges that might dig into the circumferential peripheral surface of the cover portion.

From the foregoing description and the accompaning drawing, it is evident that the present invention provides an improved overcap and package. Although the present invention has been described in conjunction with the illustrated overcap and container embodiments, it should be understood that various modifications may be used without departing from the spirit and essential characteristics of the invention. Accordingly, all such modifications are intended to be included within the scope of the appended claims.

We claim:

1. An overcap for use wth a hermetically sealed container wherein said container includes a hollow body portion; a neck portion unitary with said body portion and having an external thread on a generally cylindrical peripheral surface; a cover portion closing said neck portion; and a severable frangible web joining said cover portion to said neck portion as a unitary structure and defining a line of weakness between said neck portion and said cover portion; said overcap comprising:

an elongate hollow body having a closed end and an open end, said body having a generally cylindrical peripheral wall oriented about a longitudinal axis;

an internal thread on the interior of said overcap along said peripheral wall for engaging said neck portion external thread; and a plurality of flexible fingers on the interior of said overcap body extending from said peripheral wall between said internal thread and said closed end, each said finger projecting inwardly toward said longitudinal axis and toward said closed end whereby, when said overcap is screwed onto said container neck portion, each said finger is temporarily deflected outwardly as it is carried past at least a part of said cover portion after which it assumes a rest position so that said overcap is operable upon rotation in the unscrewing direction to exert through said fingers an axial force away from said container body portion and against said cover portion to fracture said line of weakness for removal of said cover portion.

2. The overcap in accordance with claim 1 in which at least some of said fingers each have (1) an upwardly facing bearing surface for bearing against a surface of said cover portion and (2) an abutment surface at a generally right angle to said bearing surface for engaging another surface of said cover portion.

3. The overcap in accordance with claim 2 in which said finger bearing surface is generally flat and extends around a portion of the overcap interior.

4. The overcap in accordance with claim 2 for use with said container wherein said other surface of said container cover portion is a cylindrical peripheral surface and in which each said overcap finger abutment surface makes only substantially point contact with said cover portion cylindrical peripheral surface.

5. The overcap is accordance with claim 1 in which there are six of said fingers equally spaced about the interior of said overcap.

6. The overcap in accordance with claim 1 in which said overcap includes vertically aligned grooves on the exterior of said peripheral wall to facilitate gripping of the overcap.

7. The overcap in accordance with claim 1 in which said fingers project inwardly toward said longitudinal axis beyond the innermost projection of said overcap thread.

8. A hermetically sealed package comprising:

a container having a hollow body portion, a neck portion unitary with said body portion and having a peripheral surface with an external helical thread, a cover portion closing said neck portion, a severable frangible web joining said neck portion and said cover portion as a unitary structure and defining a line of weakness between said neck portion and said cover portion; and an overcap mounted on said container neck portion over said cover portion, said overcap having a generally cylindrical peripheral wall terminating in a closed end and an open end, said overcap having an internal helical thread in the peripheral wall adjacent said overcap open end and threadingly engaged with said external thread on said container neck portion, said overcap having a plurality of circumferentially spaced-apart, flexible internal fingers extending inwardly in said overcap from said perpiheral wall between said internal thread and said closed end, each said finger projecting toward said cover portion, each said finger also being angled toward the closed end and being deflectable outwardly as it is carried past at least a part of said cover portion, whereby said overcap is operable upon rotation in the unscrewing direction to exert an axial force through said fingers away from said body portion and against said cover portion to fracture said line of weakness for removal of said cover portion.

9. The package in accordance with claim 8 in which said cover portion includes an annular base portion projecting radially outwardly from said neck portion to present a downwardly facing bottom surface and a circumferential peripheral surface; in which each said finger includes an upwardly facing bearing surface and an inwardly facing abutment surface, said bearing surface being adapted to engage the downwardly facing bottom surface of said cover portion base portion and said abutment surface being adapted to engage the circumferential peripheral surface of said cover portion base portion.

10. A hermetically sealed package comprising:

a container having a hollow body portion, a neck portion unitary with said body portion and having a peripheral surface with an external helical thread, a cover portion closing said neck portion, a severable frangible web joining said neck portion and said cover portion as a unitary structure and defining a line of weakness between said neck portion and said cover portion, said neck portion including a tapered annular seat below said frangible web, and said container further including a separate removable inner closure with a tapered annular side wall sealingly engaged with said seat; and an overcap mounted on said container neck portion over said cover portion, said overcap having a generally cylindrical peripheral wall terminating in a closed end and an open end, said overcap having an internal helical thread in the peripheral wall adjacent said overcap open end and threadingly engaged with said external thread on said container neck portion, said overcap having a plurality of circumferentially spaced-apart, flexible internal fingers extending inwardly in said overcap from said peripheral wall between said internal thread and said closed end, each said finger projecting toward said cover portion, each said finger also being angled toward the closed end and being deflectable outwardly as it is carried past at least a part of said cover portion when said overcap is screwed onto said neck portion after which said finger assumes a rest position engaging said cover portion, whereby said overcap is operable upon rotation in the unscrewing direction to exert an axial force through said fingers against said cover portion to fracture said line of weakness for removal of said cover portion.

11. A hermetically sealed package comprising:

a container having a hollow body portion, a neck portion unitary with said body portion and having a peripheral surface with an external helical thread, a cover portion closing said neck portion, a severable frangible web joining said neck portion and said cover portion as a unitary structure and defining a line of weakness between said neck portion and said cover portion, said neck portion including a tapered annular seat below said frangible web, and said container further including a separate inner closure with a tapered annular side wall engaged with said seat; and an overcap mounted on said container neck portion over said cover portion, said overcap having a generally cylindrical peripheral wall terminating in a closed end and an open end, said overcap having an internal helical thread in the peripheral wall adjacent said overcap open end and threadingly engaged with said external thread on said container neck portion, said overcap having a plurality of circumferentially spaced-apart, flexible internal fingers extending inwardly in said overcap from said peripheral wall between said internal thread and said closed end, each said finger projecting toward said cover portion, each said finger also being angled toward the closed end and being deflectable outwardly as it is carried past at least a part of said cover portion when said overcap is screwed onto said neck portion after which said finger assumes a rest position engaging said cover portion, whereby said overcap is operable upon rotation in the unscrewing direction to exert an axial force through said fingers against said cover portion to fracture said line of weakness for removal of said cover portion, and said overcap including a bearing member for engaging said cover portion after it has been severed and for forcing the severed cover portion downwardly toward said neck portion to urge said inner closure against said neck portion annular seat to effect resealing of the container.

12. The package in accordance with claim 11 in which said inner closure is captured within, and hermetically sealed to, said cover portion.

13. A hermetically sealed package comprising:

a container having a hollow body portion, a neck portion unitary with said body portion and having a peripheral surface with an external helical thread, a cover portion closing said neck portion, a severable frangible web joining said neck portion and said cover portion as a unitary structure and defining a line of weakness between said neck portion and said cover portion, said neck portion including a tapered annular seat below said frangible web, said container further including a separate inner closure with a tapered annular side wall engaged with said seat, said cover portion including a central dome over said inner closure, and said inner closure defining a reservoir opening upwardly toward said dome portion for containing a liquid; and an overcap mounted on said container neck portion over said cover portion, said overcap havinga generally cylindrical peripheral wall terminating in a closed end and an open end, said overcap having an internal helical thread in the peripheral wall adjacent said overcap open end and threadingly engaged with said external thread on said container neck portion, said overcap having a plurality of circumferentially spaced-apart, flexible internal fingers extending inwardly in said overcap from said peripheral wall between said internal thread and said closed end, each said finger projecting toward said cover portion, each of said finger also being angled toward the closed end and being deflectable outwardly as it is carried past at least a part of said cover portion when said overcap is screwed onto said neck portion after which said finger assumes a rest position engaging said cover portion, whereby said overcap is operable upon rotation in the unscrewing direction to exert an axial force through said fingers against said cover portion to fracture said line of weakness for removal of said cover portion.

14. An overcap for use with a hermetically sealed container wherein said container includes at least an external thread on a portion of the container, a cover portion closing said container, and a severable juncture connecting said cover portion to said container threaded portion and defining a line of weakness between said container threaded portion and said cover portion, said overcap comprising:

a hollow, elongated body having a closed end and an open end, said body having a hollow peripheral portion oriented about a longitudinal axis and provided with an internal thread for engaging said container external thread;

a plurality of spaced flexible fingers on the interior of said hollow body extending from said interior between said internal thread and said closed end, each said finger projecting inwardly toward said longitudinal axis and toward said closed end and adopted to accommodate the cover portion of the container within the hollow, elongated body; and said overcap being operable during removal from the container to exert an axial force away from said container threaded portion and against said cover portion to sever said line of weakness.

15. The overcap in accordance with claim 14 wherein each said overcap finger is provided with an abutment surface that makes only substantially point contact with an adjacent part of said container cover portion.

16. The overcap in accordance with claim 14 in which said overcap has a generally cylindrical peripheral wall which in part defines said hollow peripheral portion and in which said overcap closed end is a generally circular end wall joined about its periphery to said generally cylindrical peripheral wall of said overcap.

* * * * *

UNITED STATES PATENT AND TRADEMARK OFFICE

CERTIFICATE OF CORRECTION

PATENT NO. : 4,526,279

DATED : July 2, 1985

INVENTOR(S) : Gerhard H. Weiler and Louis T. Pagels

It is certified that error appears in the above-identified patent and that said Letters Patent is hereby corrected as shown below:

Col. 9, line 22, after "portion" delete the comma (,) and insert -- when said overcap is screwed onto said neck portion after which said finger assumes a rest position engaging said cover portion, --.

Signed and Sealed this

*Third* Day of *December 1985*

[SEAL]

*Attest:*

DONALD J. QUIGG

*Attesting Officer*

*Commissioner of Patents and Trademarks*